US005498180A

United States Patent [19]

Krantz et al.

[11] Patent Number: 5,498,180

[45] Date of Patent: Mar. 12, 1996

[54] DIODE/FILTER CONNECTOR

[75] Inventors: Leonard A. Krantz, Sidney; Joseph D. Magnan, South Kortright; Stephen Punako, Bainbridge, all of N.Y.

[73] Assignee: Amphenol Corporation, Wallingford, Conn.

[21] Appl. No.: 956,416

[22] Filed: Oct. 5, 1992

[51] Int. Cl.[6] ..... H01R 11/22

[52] U.S. Cl. ..... 439/851; 439/751; 439/620

[58] Field of Search ..... 439/95, 620, 851, 439/751

[56] References Cited

U.S. PATENT DOCUMENTS

| | | | |
|---|---|---|---|
| 3,743,979 | 7/1973 | Schor | 333/79 |
| 3,961,295 | 6/1976 | Hollyday et al. | 333/79 |
| 4,020,430 | 4/1977 | Vander Heyden | 439/620 X |
| 4,376,922 | 3/1983 | Muzslay | 333/182 |
| 4,572,600 | 2/1986 | Nieman | 339/14 R |
| 4,600,262 | 7/1986 | Nieman et al. | 339/147 R |
| 4,707,048 | 11/1987 | Gliha et al. | 439/620 |
| 4,741,710 | 5/1988 | Hogan et al. | 439/620 |
| 4,746,310 | 5/1988 | Morse et al. | 439/620 |
| 4,747,789 | 5/1988 | Gliha | 439/620 |
| 4,768,977 | 9/1988 | Gliha, Jr. et al. | 439/620 |
| 4,954,794 | 9/1990 | Nieman et al. | 333/182 |
| 5,046,968 | 9/1991 | Baur et al. | 439/620 |
| 5,112,253 | 5/1992 | Swift | 439/620 |
| 5,164,873 | 11/1992 | Krantz et al. | 439/620 X |

FOREIGN PATENT DOCUMENTS

| | | |
|---|---|---|
| 0070683 | 1/1983 | European Pat. Off. . |
| 0487984 | 6/1992 | European Pat. Off. . |
| 1134358 | 11/1968 | United Kingdom . |

*Primary Examiner*—David L. Pirlot
*Attorney, Agent, or Firm*—Bacon & Thomas

[57] ABSTRACT

An electrical connector filter or transient suppression component structure includes a component body, a first lead adapted to electrically contact a feedthrough contact pin in an electrical connector and a second lead adapted to engage a ground plate. The first lead may be cylindrical to extend all the way around the contact pin, the second lead including a cylindrical termination section which electrically connects the component to the ground plate by engaging an aperture provided in the ground plate. The components are housed in a dielectric insert assembly which, in one embodiment includes pairs of circular openings at one end and rectangular/circular opening pairs at the other end, the component body being inserted into a rectangular opening and the contacts and termination section extending through the circular openings. The second end of the insert may include projections surrounding one circular opening in each of the pairs of circular openings to insulate the contacts from the ground plate, the projections extending through circular openings in the ground plate and the cylindrical termination sections of the ground lead extending through and engaging additional circular openings in the ground plate.

61 Claims, 11 Drawing Sheets

DIODE/FILTER CONNECTOR

BACKGROUND OF THE INVENTION

1. Field of the Invention

This invention relates to electrical connectors, and in particular to an arrangement for removably mounting a transient suppression or electrical filter device in an electrical connector.

2. Discussion of the Related Art

It has previously been proposed to place diodes and other nuclear electromagnetic pulse (EMP) or transient voltage suppression (TVS) electrical components on electrical contacts for the purpose of facilitating their use in high or medium density electrical connectors. Examples are shown in U.S. Pat. Nos. 4,741,710, 4,746,310, and 4,747,789. Present technology, exemplified by the connectors shown in these patents, requires that the component be bonded to the contact by the connector manufacturer.

The step of bonding greatly increases the cost to the connector manufacturer of manufacturing the tom ponent/contact assembly because connector manufacturers ordinarily do not possess the state-of-the-art technology required to permanently bond a semi-conductor diode or other component chip directly to a contact. Therefore, the connector manufacturer is required to either purchase or develop the requisite technology, or to manufacture only the contact and send it back to the diode manufacturer for attachment of the component. Unfortunately, once the component is bonded to the contact, it cannot easily be removed, and thus if either the component or the contact turns out to be defective, both the contact and the component must be discarded, further increasing costs.

Generally, it is the connector manufacturer rather than the component manufacturer who bonds the component to the contact. The connector manufacturer is thus required to handle the component, modify the standard contact, complete the attachment of the component to the contact, and perform screen testing on the contact assembly which is over and above the screening performed by the component manufacturer. Such redundant testing is inefficient, as is the need to handle the component by both the manufacturer and the connector assembler, and the extra steps required to prepare or machine the contact to accommodate the component. All of these disadvantages could be avoided if a satisfactory arrangement existed for non-permanently but securely mounting a component together with a contact in a connector.

In order to solve the above-mentioned disadvantages of prior arrangements for removably mounting transient suppression or filter components within connectors, it was proposed in U.S. Pat. No. 5,112,253 to provide a component mounting arrangement having a component holder slotted to receive the component, a metal contact clip for providing a releasably mechanical and electrical interface between the component and the contact, and a ground plate utilizing integral spring tines for electrically connecting the component to ground and for releasably securing the component in the holder. This arrangement is well-suited for the type of connector shown, and represents a significant improvement over any other prior art arrangements, including the capacitor insert arrangement of U.S. Pat. No. 4,376,922, which lacks removability for repair and replacement, or the diode chip mounting arrangement for U.S. Pat. No. 4,707,048, which lack mechanical stability and exposes the diode to damage if replacement is attempted.

Despite the above-noted advantages, the present invention proposes to still further improve the mounting arrangement of U.S. Pat. No. 5,112,253 for most applications, by providing the diode with integral lead structures which replace the separate clip used in the arrangement of U.S. Pat. No. 5,112,253 to hold the component in place and electrically connect it to the contact pins of the connector. A wide variety of lead arrangements are disclosed in the present specification, each of which is intended to provide an alternative to the design of U.S. Pat. No. 5,112,253, and all of which share the principle of integral lead structures. In many of the embodiments disclose herein, even though the component is removable from the pin contact, it is nevertheless removable with the pin contact, thereby simplifying repair and removal procedures and providing additional mechanical stability and improved electrical characteristics.

SUMMARY OF THE INVENTION

In order to solve the above-mentioned disadvantages of prior arrangements for removably mounting transient suppression or filter components within connectors, and to provide certain improvements over the component mounting arrangement disclosed in U.S. Pat. No. 5,112,253, it is an objective of the invention to provide a mechanically stable arrangement for safely and removably mounting a transient suppression or filter component within a connector, in which the component is not required to be bonded to the contact but rather is secured thereto by an integral electrically conductive component lead structure.

This objective is achieved by providing component mounting arrangements in which the component is provided with a lead structure specifically designed to electrically connect the component to the contact, and a second integral lead structure adapted to engage a ground member in the connector.

In each of the preferred embodiments of the invention, the component includes a rectangular component body mounted on edge off-center from the connector contact via specially designed component leads to provide pressure to both the connector contact and to a grounding disk in the connector, the leads preferably being fixedly attached to the body by a metallurgical bonding technique such as soldering. A connector insert is provided to support the component, contain the ground plate, support the connector contact, and provide interference so that pressure will be generated between the contact, component, ground plate, and insert.

In one preferred embodiment of the invention, the component includes a ground lead designed as a spring with the component body located at the apogee of the spring. On the other side of the component body is another lead shaped to accept the radius of the contact. The second lead provides the required interference to the contact so as to bias the component with sufficient pressure to the other lead, which will in turn maintain pressure to the ground system. The ground plate is attached to an insert so that when installed into a connector it provides a ground connection to the connector shell.

In a second preferred embodiment of the invention, the lead in contact with the connector contact is the spring lead. The lead on the opposite face of the component is the ground lead and is attached to the ground system. Again, the insert and component location are designed to provide sufficient interference with the connector contact so as to provide pressure sufficient to maintain low impedance continuity between the contact and component.

In a third preferred embodiment of the invention, the first lead is in the form of a socket while the ground lead is in the form of a plug which fits into a suitably shaped holes provided in the ground plate to electrically connect the lead with the ground plate. The insert is designed so that the components contained therein are placed off center of the connector contact locations, the components residing in recesses which are arranged so as not to interfere with adjacent recesses.

In conjunction with this embodiment of the invention, a unique ground plate is provided with a contact clearance hole and a ground lead insertion hole. This latter embodiment has the advantage of maximum flexibility in the manner in which the ground lead can be configured.

Finally, in a fourth embodiment of the invention, the first lead is in the form of an in-line feedthrough contact structure, while the ground lead is again in the form of a plug which fits into a suitably shaped hole provided in the ground plate.

BRIEF DESCRIPTION OF THE DRAWINGS

FIG. 6(*b*) is a cross-sectional side view of the lead structure of FIG. 6(*a*).

FIG. 6(*c*) is an elevated side view of the lead structure of FIG. 6(a).

FIG. 6(*d*) is an elevated bottom view of the lead structure of FIG. 6(a).

FIG. 6(*e*) is a second end view of the lead structure of FIG. 6(*a*).

FIG. 7(*b*) is an elevated top view of the ground lead structure of FIG. 7(*a*).

FIG. 7(*c*) is a elevated side view of the ground lead structure of FIG. 7(*a*).

FIG. 7(*d*) is a second end view of the ground lead structure of FIG. 7(*a*).

FIG. 9(*b*) is an enlargement of a portion of the end view of FIG. 9(*a*).

FIG. 9(*c*) is a second elevated end view of the insert structure of FIG. 9(*a*).

FIG. 9(*d*) is an enlargement of a portion of the end view of FIG. 9(*c*).

FIG. 9(*e*) is a perspective view of a complete filter or transient suppression component insert assembly utilizing the lead structure of FIGS. 5–8.

FIG. 9(*f*) is an end view schematically representing the ground plate of FIG. 8.

FIG. 9(*g*) is a cross-sectional side view of the ground plate of FIG. 8 as represented in FIG. 9(*f*).

FIG. 10(*b*) is an elevated side view of the transient suppression or filter component and lead assembly of FIGS. 4 and 5 in combination with a variation of the contact of FIG. 10(*a*).

FIG. 10(*c*) is an elevated side view of the transient suppression or filter component and lead assembly of FIGS. 4 and 5 in combination with a second variation of the contact FIG. 10(*a*).

FIG. 11(*b*) is a perspective view of the transient suppression or filter component mounting arrangement of FIG. 11(*a*).

FIG. 11(*c*) is a perspective view of a variation of the live lead shown in FIGS. 11(*a*) and 11(*b*).

FIG. 11(*d*) is an elevated top view of the lead of FIG. 11(*c*).

FIG. 11(*e*) is an elevated side view of the lead of FIG. 11(*c*).

DETAILED DESCRIPTION OF THE PREFERRED EMBODIMENTS

Figure 1:
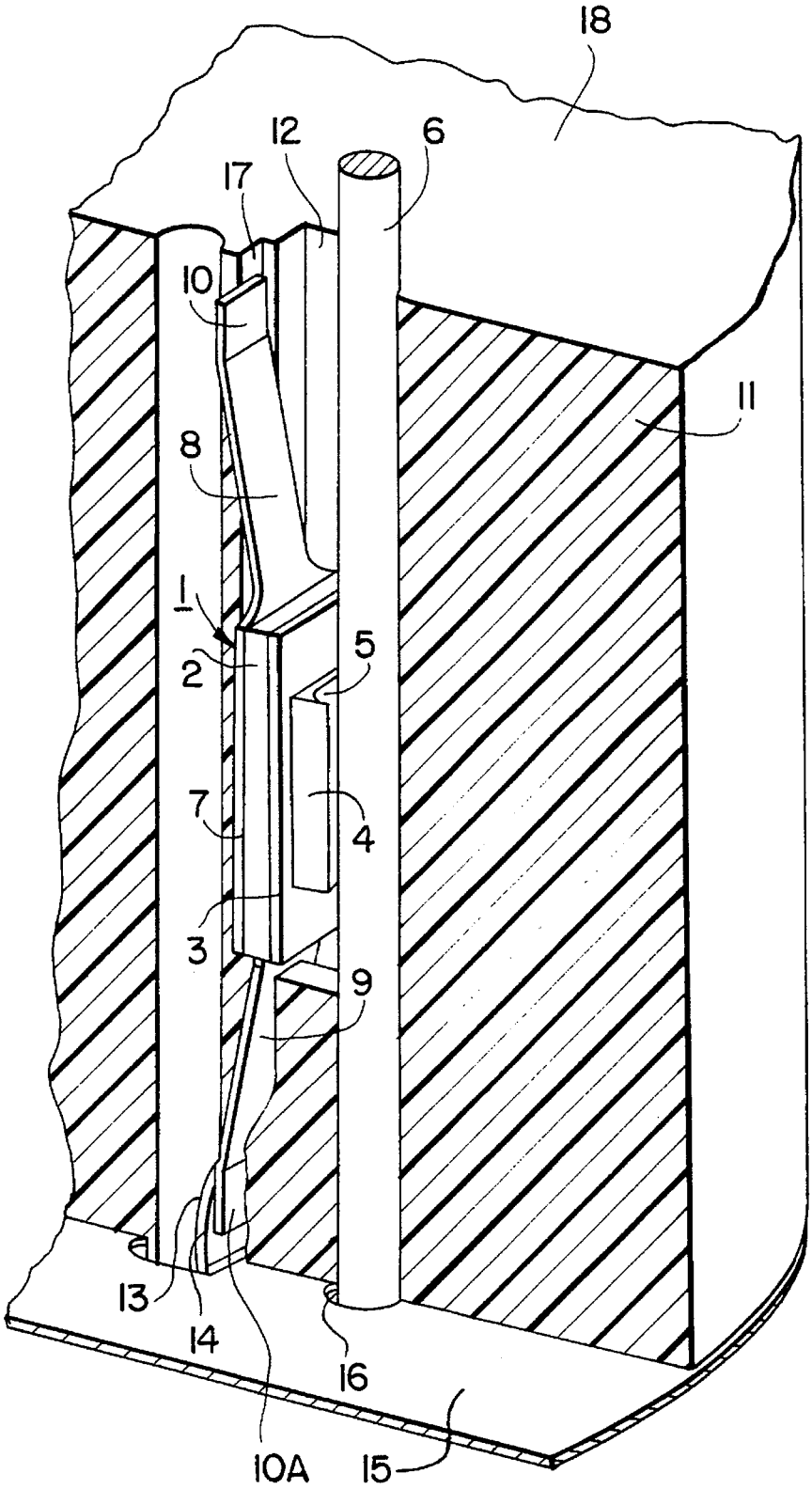
FIG. 1 is a cross-sectional perspective view of a transient suppression or filter component arrangement for a connector constructed in accordance with principles of a first embodiment of the invention.

A first preferred embodiment of the invention is shown in FIG. 1. In this embodiment, the transient suppression or filter component assembly 1 includes a component body 2, for example a diode body as described below, and a first or live lead 3. Lead 3 has a projection 4 extending in a direction transverse to a principal plane of component body 2 and which includes a groove 5 for removably engaging a connector contact pin 6. Assembly 1 also includes a second lead 7 which serves as a ground lead and which includes two integral arms 8 and 9 extending at a small angle away from the principal plane of the component and ending in contact portions 10 and 10A such that the ground lead 7 forms a spring member with the transient suppression or filter component body 2 located at the apogee of the spring. Groove 5 is preferably shaped to accept the radius of the contact pin.

The component assembly 1 and the contact pin 6 are separately removable from connector insert member 11 and a recess 12 of the insert member in which assembly 1 is positioned. Arm 9 of ground spring 7 extends into an extension 13 of recess 12 and there engages an arm or extension 14 of ground plate 15. Ground plate 15 includes two types of recesses, one formed by the cutout of arm 14, and the second recess 16 permitting the contact pin 6 to pass through. It will be appreciated by those skilled in the art that ground plate 15 and contact pin 16 must be isolated from each other, and therefore suitable insulation may be placed between the edges of aperture 16 and the contact pin.

Arm 8 of lead 7 engages a surface 17 which forms one side of groove 12, and together arms 8 and 9 and lead 7 serve to bias portion 4 of lead 3 against the contact pin to establish a secure electrical contact between both the ground plate 15 and lead 7, and between the signal contact pin 6 and lead 3. Because the bias force provided by arms 8 and 9 is sufficient to establish a good electrical contact between lead 3 of the component assembly and the signal contact 6, it is not necessary to permanently secure lead 3 to signal contact pin 6, and yet the entire assembly 1 can easily be removed from the opening of recess 12 at the top surface 18 of insert 11.

Figure 2:
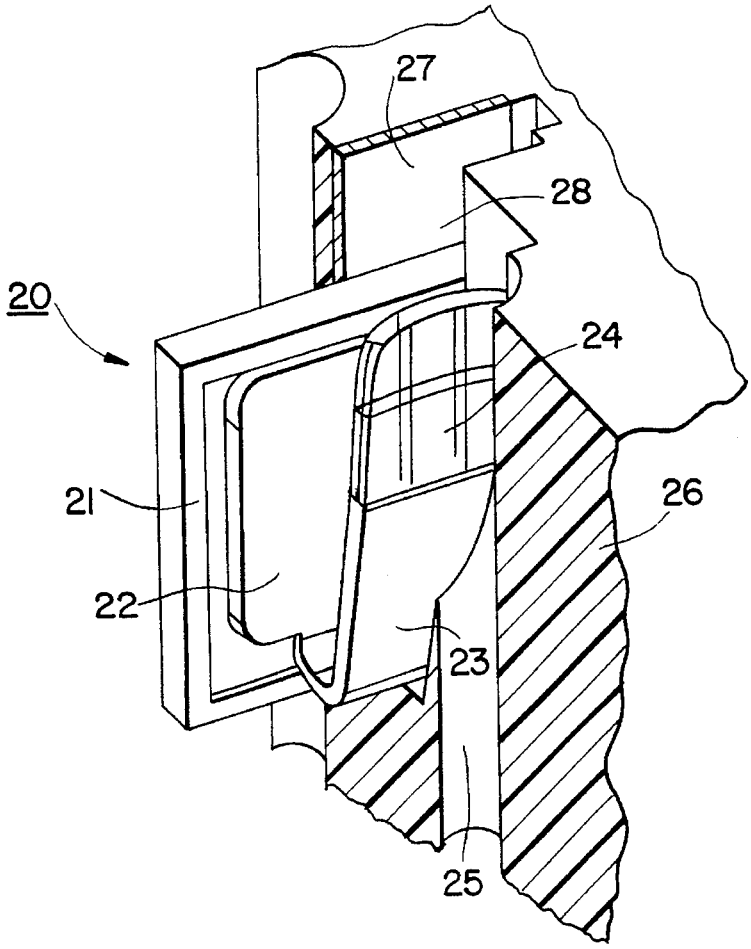
FIG. 2 is a cross-sectional perspective view showing a transient suppression or filter component mounting arrangement for a connector in accordance with principles of a second preferred embodiment of the invention.
Figure 3:
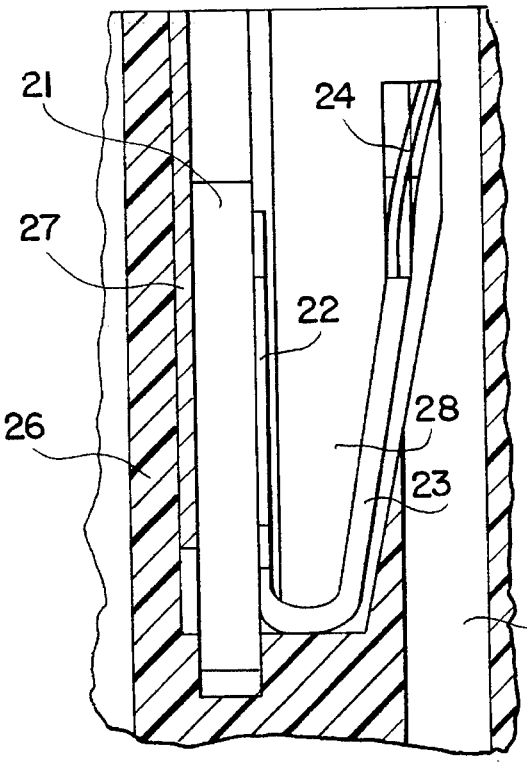
FIG. 3 is a cross-sectional side view of the transient suppression or filter component mounting arrangement of FIG. 2.

A second preferred arrangement in which the transient suppression or filter component can be removed from the insert after the removal of the contact is shown in FIGS. 2 and 3. This embodiment is similar to the first embodiment except that the spring lead rather than the ground lead in contact with the contact pin. As described below, the lead on the opposite face of the component from the spring lead is the ground lead and is electrically connected to the ground system (not shown). Again, the insert and diode location is designed to provide sufficient interference with the connector contact pin so as to provide sufficient pressure to maintain low impedance continuity between the contact pin and the component.

In this embodiment, the transient suppression or filter component assembly 20 includes a component body 21 and a first lead 22 which includes an extension 23 ending in a contact portion 24 arranged to extend into a contact receiving passage or recess 25 in insert 26 such that when the contact (not shown) is inserted into recess 25, the end portion 24 engages tile contact and is pushed in the direction of the component body, thereby biasing the component body in the direction of the wall of the insert. A ground member 27, which may be in the form of a lead attached to the component body or an extension of some other grounding means, is electrically connected to the connector shell by means not shown. Component assembly 20, with at least first lead 22, may thus easily be removed from recess 28 upon removal of the contact from passage 25.

It will be appreciated by those skilled in the art that although the invention is especially suited for use with transient suppression or filter components, and in particular transient suppression diodes, other electrical components may be substituted. For example, if the connector circuit is to be directly connected to ground, the transient suppression or filter can be replaced with a conductive device so that there will be continuity between the pin and the connector shell.

An exemplary diode for use with the disclosed connector arrangements is rectangular in form, and has a sufficient surface area to absorb 1500 Watts of energy from a 10×1000 microsecond exponential pulse. The unique design of the invention permits the use of larger surface area diodes than would be the case if the diode had to be mounted on a connector pin. The junction surfaces are preferably glass passivated and appropriately metallized to provide for lead attachment using normal industry means. The present convention for the contact pattern of high density connectors requires a diode which has a maximum dimension of 0.120 inch per side, with axial leads. Currently popular connectors are constructed with 0.030 diameter contacts mounted on 0.100, 0.095 or 0.090 inch centers.

Figure 8:
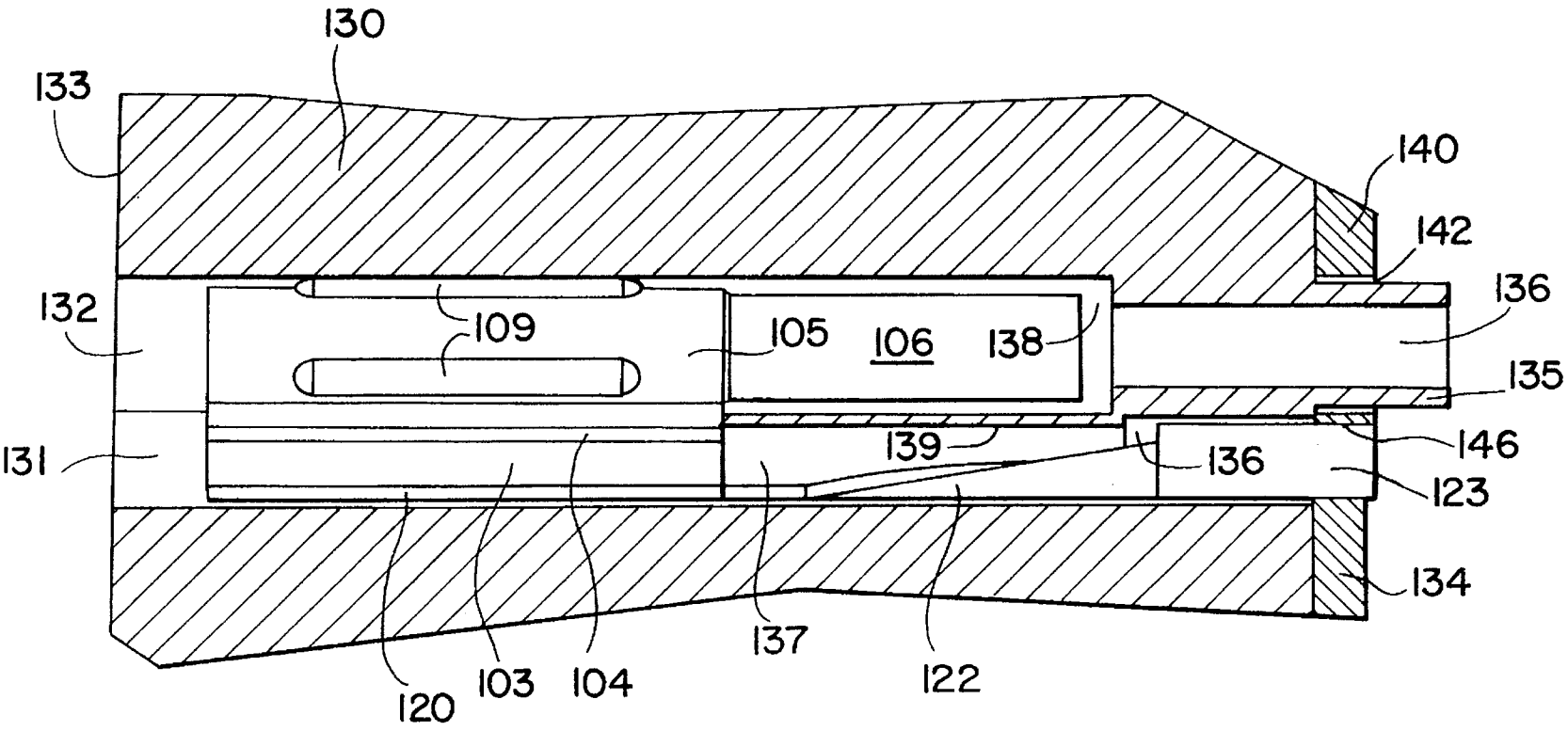
FIG. 8 is a cross-sectional side view showing the manner in which the assembly of FIGS. 4, 5, 6(*a*)–6(*e*), and 7(*a*)–7(*d*) cooperate with a ground plate and insert structure of a transient suppression or filter connector.
Figure 9E:
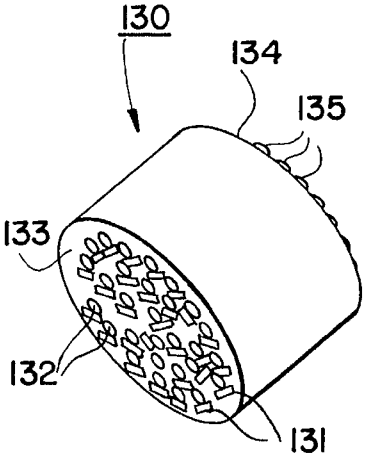
FIG. 9(*a*) is an elevated end view of the insert structure shown in FIG. 8.
Figure 9C:
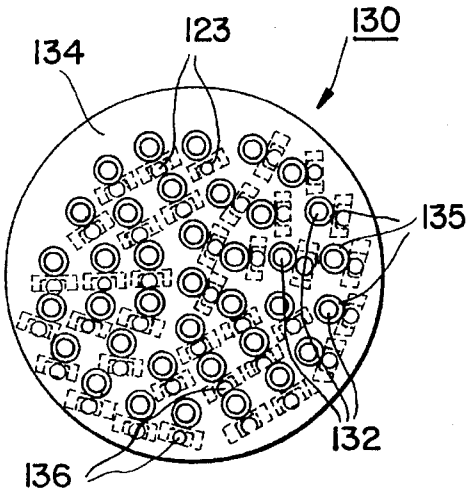
Figure 9D:
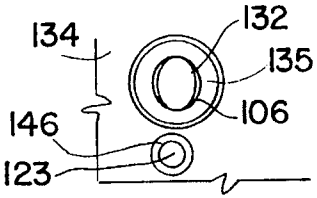
Figure 9A:
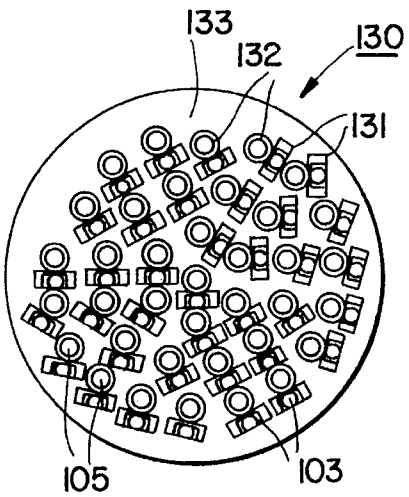
Figure 9B:
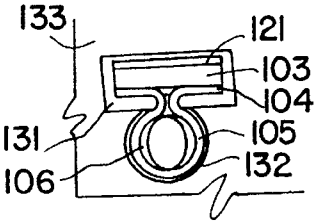
Figure 9F:
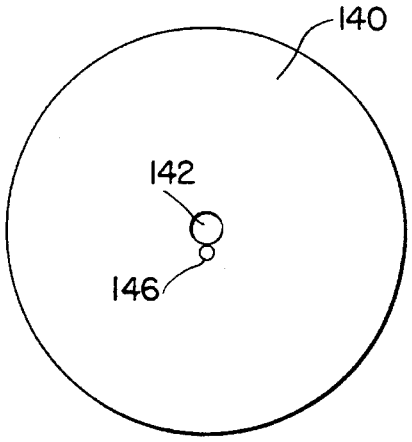
Figure 9G:
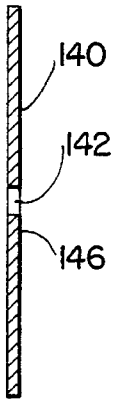
Figure 10A:
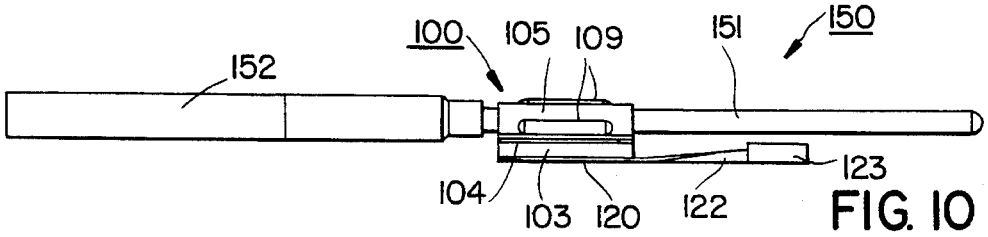
FIG. 10(*a*) is an elevated side view of a contact in combination with the transient suppression or filter component and lead assembly of FIGS. 4 and 5.
Figure 10B:
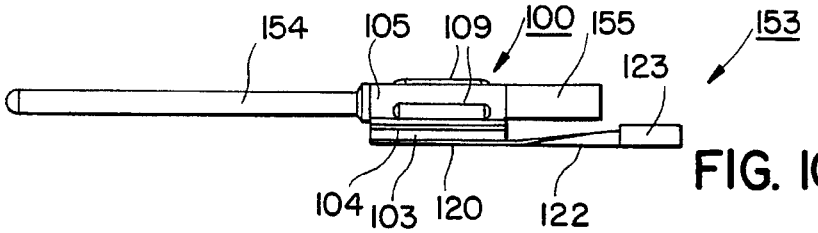
Figure 10C:
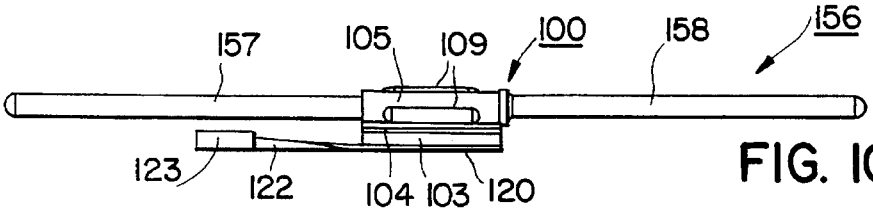
Figure 11A:
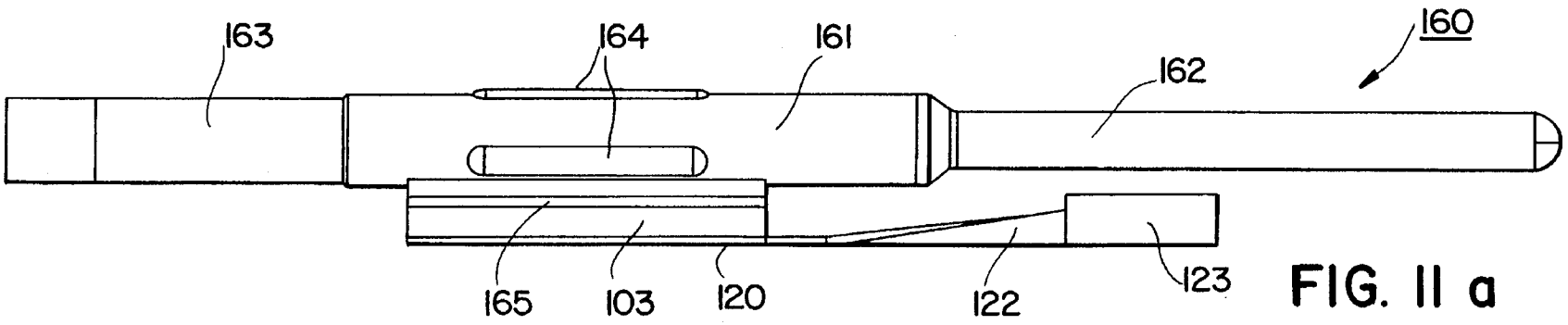
FIG. 11(*a*) is an elevated side view of a transient suppression or filter component mounting arrangement including an in-line feedthrough lead structure constructed in accordance with principles of a fourth embodiment of the invention.
Figure 11B:
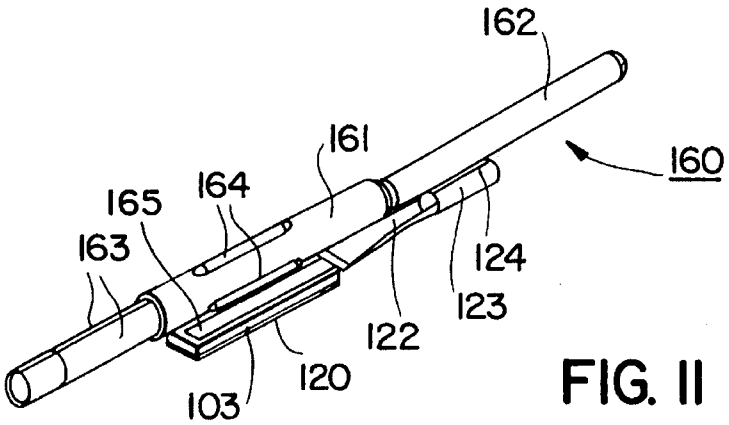
Figure 11C:
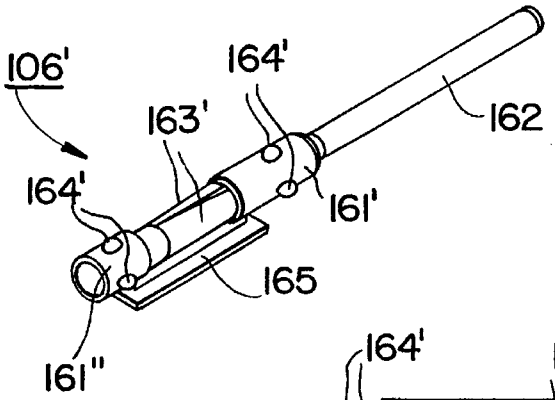
Figure 11D:
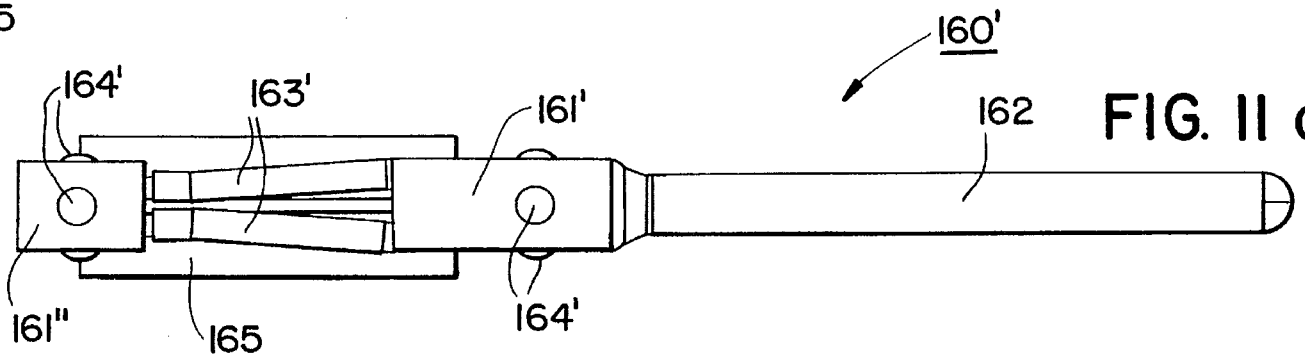
Figure 11E:
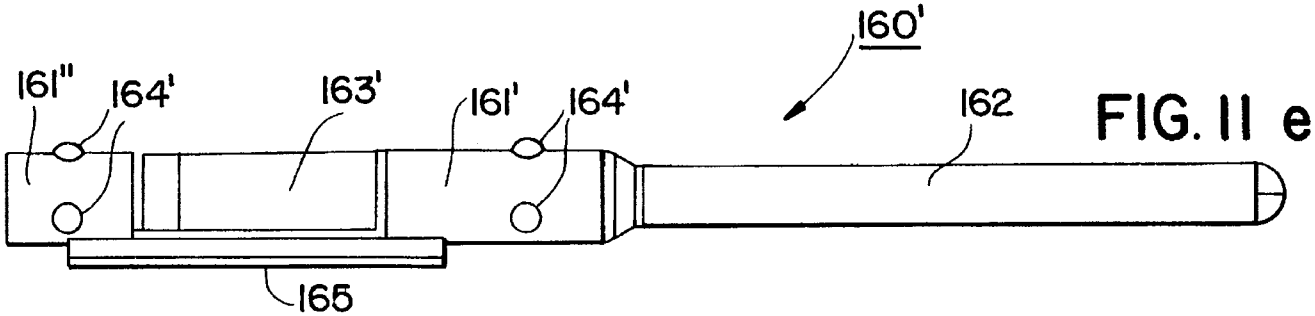

A third embodiment of the invention is shown in FIGS. 4–10. The novel principle of adapting the component leads to mount of the component in offset fashion is used in this embodiment to provide a coupling arrangement which is especially convenient and mechanically stable. The complete transient suppression or filter component assembly is shown in perspective in FIGS. 4 and 5. Its application to various contact pins is shown in FIGS. 10(*a*)–10(*c*) and the manner in which the assembly is used in a connector is illustrated in FIGS. 8 and 9(*a*)– 9(*g*). FIGS. 6(*a*)–6(*e*) and 7(*a*)–7(*d*) show in detail the two leads which are included in the assembly.

Figure 4:
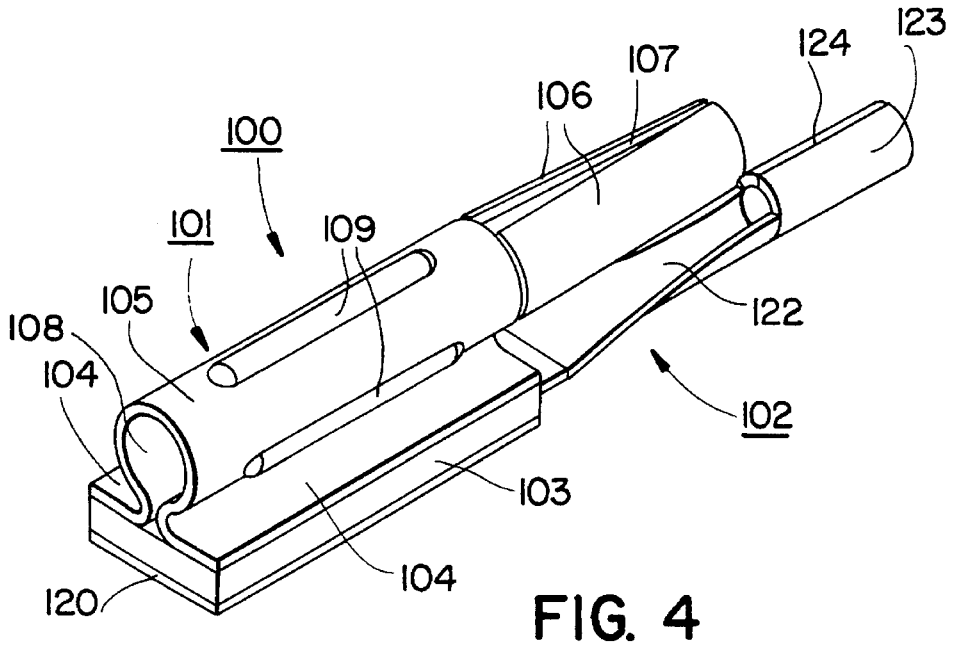
FIG. 4 is a perspective view of a transient suppression or filter component and lead assembly constructed in accordance with principles of a third preferred embodiment of the invention.
Figure 5:
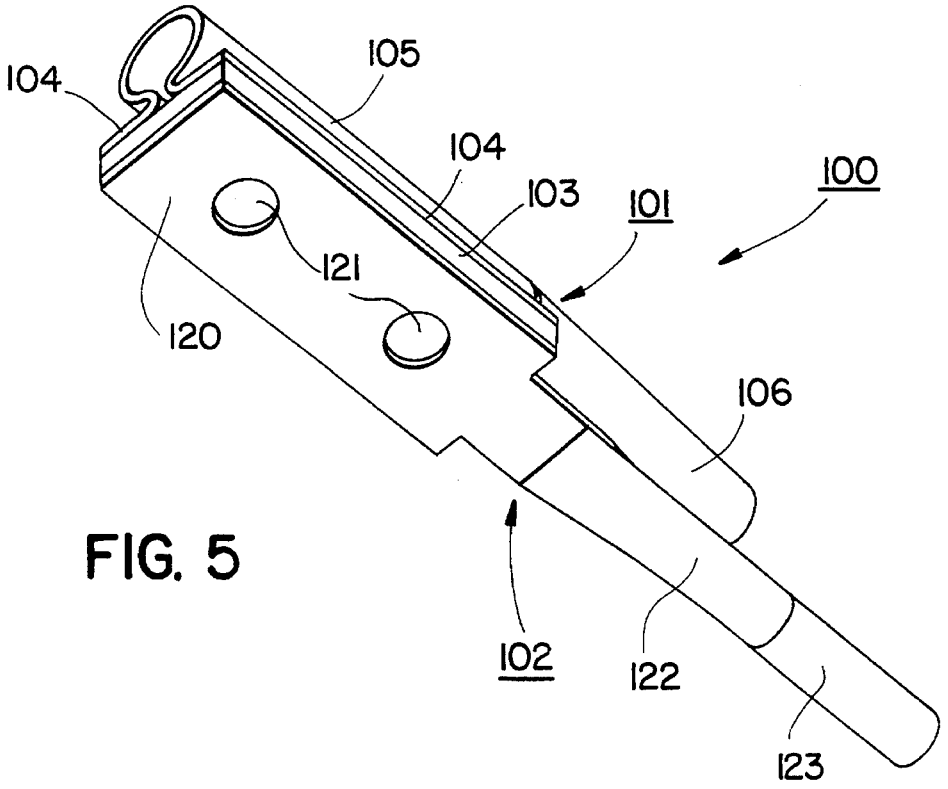
FIG. 5 is a second perspective view of the assembly of FIG. 4, showing the ground lead structure.
Figure 6E:
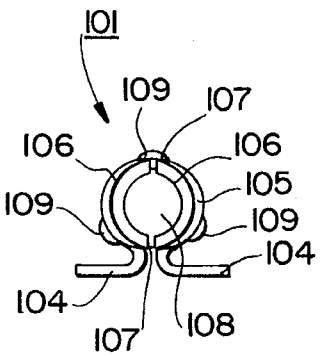
FIG. 6(*a*) is an end view of a first lead structure of the assembly of FIG.
Figure 6B:
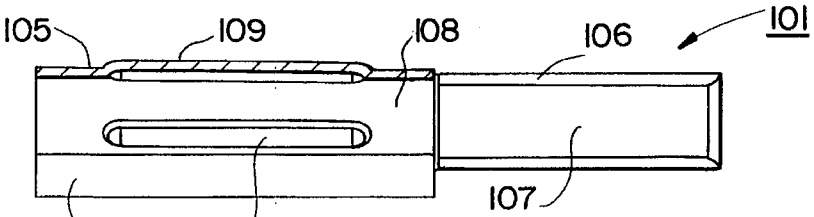
Figure 6C:
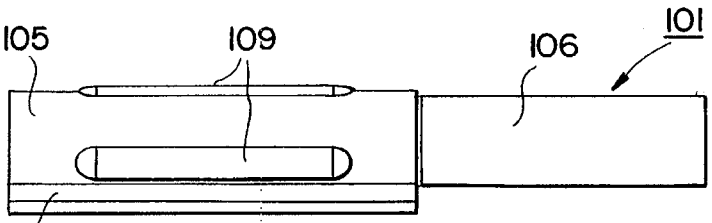
Figure 6D:
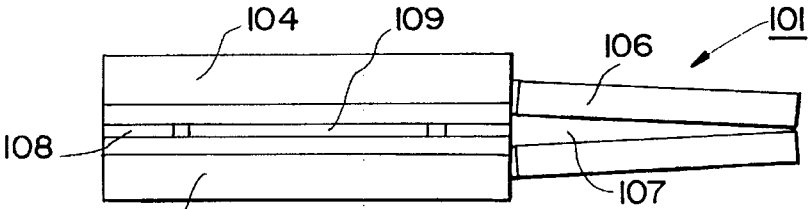
Figure 6A:
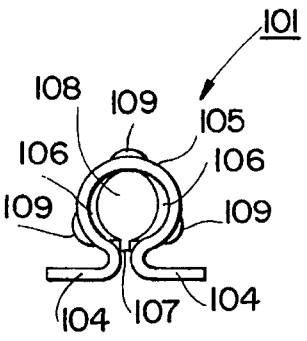
Figure 7D:
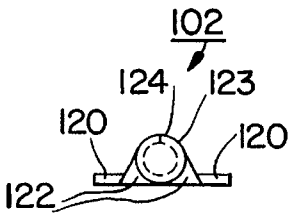
FIG. 7(*a*) is an end view of the ground lead structure of the assembly of FIG. 4.
Figure 7B:
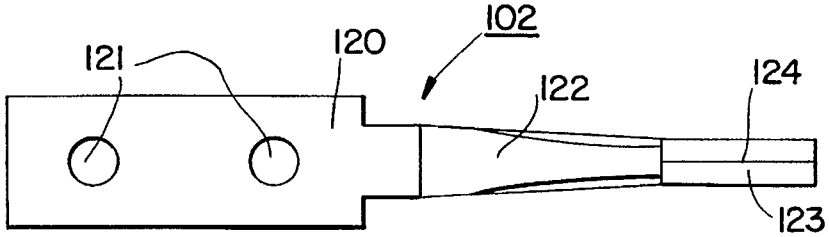
Figure 7C:
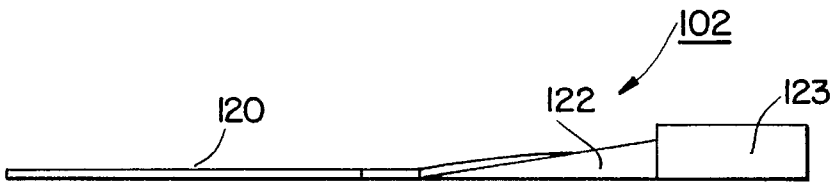
Figure 7A:
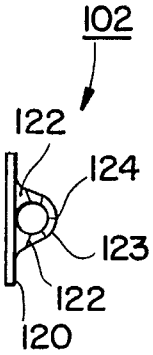

The transient suppression or filter component assembly 100 of this embodiment, as shown in FIGS. 4 and 5, includes a first lead 101, a second lead 102, and a component body 103.

The first lead is shown in greater detail in FIGS. 6(*a*)–6(*e*). Lead 101 includes three main sections 104, 105, and 106 preferably stamped and formed from a single sheet of a conductive and resilient metal such as beryllium copper. It is attached to the component body 103 by flanges 104 which are integrally formed with cylindrical main body 105. Lead 101 also includes tines 106 having a gap 107 therebetween and extending from an end of said main body in a direction substantially parallel to an axis of the main body such that a distance between distal ends of the tines is less them an interior diameter of said main body. Main body 105 is designed to accommodate a contact pin within the central hole 108, electrical contact being established by the gripping force provided by the inwardly-based tines 106, to thereby provide an especially secure and mechanically stable interface with the contact pin. Main body 105 also has extending, parallel to an axis thereof and radially outward therefrom, ribs 109 which serve to provide an interference fit between lead main body 105 and the walls of an opening or recess into which lead 101 is inserted, as is better illustrated in FIG. 8.

As is apparent from FIGS. 6(*a*) and 6(*e*), main body 105 and flanges 104 together have an omega-shaped cross-section.

The second or ground lead is best illustrated in FIGS. 7(*a*)–7(*d*). This lead is preferably also stamped and formed from a single sheet of conductive and resilient metal such as beryllium copper and includes a main portion 120 having solder relief holes 121 to facilitate attachment to the component body 103, an intermediate section 122 and a termination section 123 special adapted to engage circular openings in a ground plate and whereby electrically connect the component to ground. Termination section 123 is cylindrical and includes a gap 124 where the edges of the stamped and formed contact member face each when the contact is formed, thus providing an interference fit with the openings for an especially low impedance 360° connection, as will be apparent from the discussion of FIGS. 8, 9(*f*), and 9(*g*) below.

FIGS. 8 and 9(*a*)–9(*d*) show a cylindrical dielectric insert structure for accommodating the component and lead assembly 100 shown in FIGS. 4 and 5. Insert 130 includes a plurality of rectangular-shaped recesses 131 for the respective component assemblies and a plurality of circular openings 132 for the contact pins. The recesses 131 in insert 130 extend from only a single end face 133 of the insert, while openings 132 extend from end face 133 to the opposite end face 134. The second face 134 includes a plurality of projections 135 which serve to isolate the contact pins from the ground plate, openings 132 extending through the projections 135. Adjacent openings 135 are a plurality of openings 136. Recesses 131 communicate with openings 132 and with openings 136, the latter openings being extensions of recesses 131, but openings 132 and 136 do not otherwise communicate with each other, for reasons which will become apparent from the following discussion. The dashed rectangles shown in FIGS. 9(*c*) correspond to the rectangular recesses 131 shown in FIG. 9(*a*), but are omitted from FIG. 9(*d*) because recesses 1 31 do not extend to end face 134.

The component assemblies 100 are accommodated in rectangular recesses 131 and the contact pins and leads 101 surrounding the contact pins extend through circular openings 132, the walls of the opening being engaged by ribs 109 in an interference fit arrangement to hold the contacts in place. Extending from recess 131 to circular opening 136 is a transitional recess portion 137, shown only in FIG. 8, which is separated from a portion 138 of opening 132 by a wall 139. The termination or plug portion 123 of the ground lead 102 is arranged to project from insert 131 when the component is inserted as far as possible into opening 136.

Ground plate 140 is placed against end face 134 of insert 130 such that projections 135 extend through openings 142 and insulate the ground plate from a contact passing through openings 142. Openings 146 of ground plate 140 engage termination sections 123, which are dimensioned to provide an interference fit with openings 146. Thus, in contrast to prior arrangements, the mechanical connection to both the contact and the ground plate provides a 360° low impedance connection that is completely mechanically stable.

Ground plate 140 is otherwise similar to known ground plates, and may for example include vertical tines (not shown) for engaging the shell of the connector, except that contact with the ground lead of the component is established simply by providing the holes 146 as shown in FIGS. 9(*f*) and 9(*g*) to form adjacent pairs of openings rather than isolated openings. FIGS. 9(*f*) and 9(*g*) show only a single pair of openings but, in practice, the ground plate must include at least as many pairs of openings 142 and 146 as there are projections 135 in the insert.

FIG. 10(*a*) shows assembly 100 in combination with a contact 150 including a pin portion 151 on which the assembly is mounted, and a socket portion 152. FIG. 10(*b*) shows a similar contact 153 having a pin portion 154 on which the assembly 1 is mounted, and a socket portion 155. FIG. 10(*c*) shows a contact 156 having two pin portions 157 and 158.

The cylindrical main body 105 of component 101 assembly may be secured to the contact after testing by any suitable sophisticated attachment technique, such as by crimping. It will be appreciated that the required attachment techniques for securing the diode to the contact are far simpler than the semiconductor attachment techniques required of conventional diode contacts.

In accordance with yet another preferred embodiment of the invention, shown in FIGS. 11(*a*) and 11(*b*), rather than providing the live lead with a completely hollow cylindrical main portion into which a feedthrough contact is inserted, the live lead itself, designated by reference numeral 160, may serve as a feedthrough element connecting together two connector contacts. In this example, the component is connected to the ground plate as previously shown via ground lead 102.

A first end of lead 160 includes flanges 165 for attachment to component body 103, a main body 161, and a pin contact interface 162. Flanges 165 and main body 161 are depicted as being identical to flanges 104 and main body 105 of the embodiment of FIGS. 3–10, although variations are of course possible.

If the user does not require a pin contact interface, the termination end of the connector could also be a PCB tail, solder cup, or crimp socket. The second end of lead 160 is illustrated as a socket formed by tines 163, but could also be formed as a pin or other termination structure. Assembly 160 is designed to be used in connection with the insert shown in FIG. 9(*a*)–9(*d*), and thus includes ribs 164 similar in structure and function to ribs 109 of assembly 100.

In a variation of the embodiment of FIGS. 11(*a*) and 11(*b*), the live lead may be in the form of a lead 160', as shown in FIGS. 11(*c*)–11(*e*). Instead of being positioned at one end of main body 161, the socket structure is in the form of tines 163' integral with and positioned between hollow cylindrical main body sections 161' and 162". Detents 164', rather than ridges, securely position the lead 160' in a connector insert by engaging the insert on two sides of the tines 103.

Figure 12:
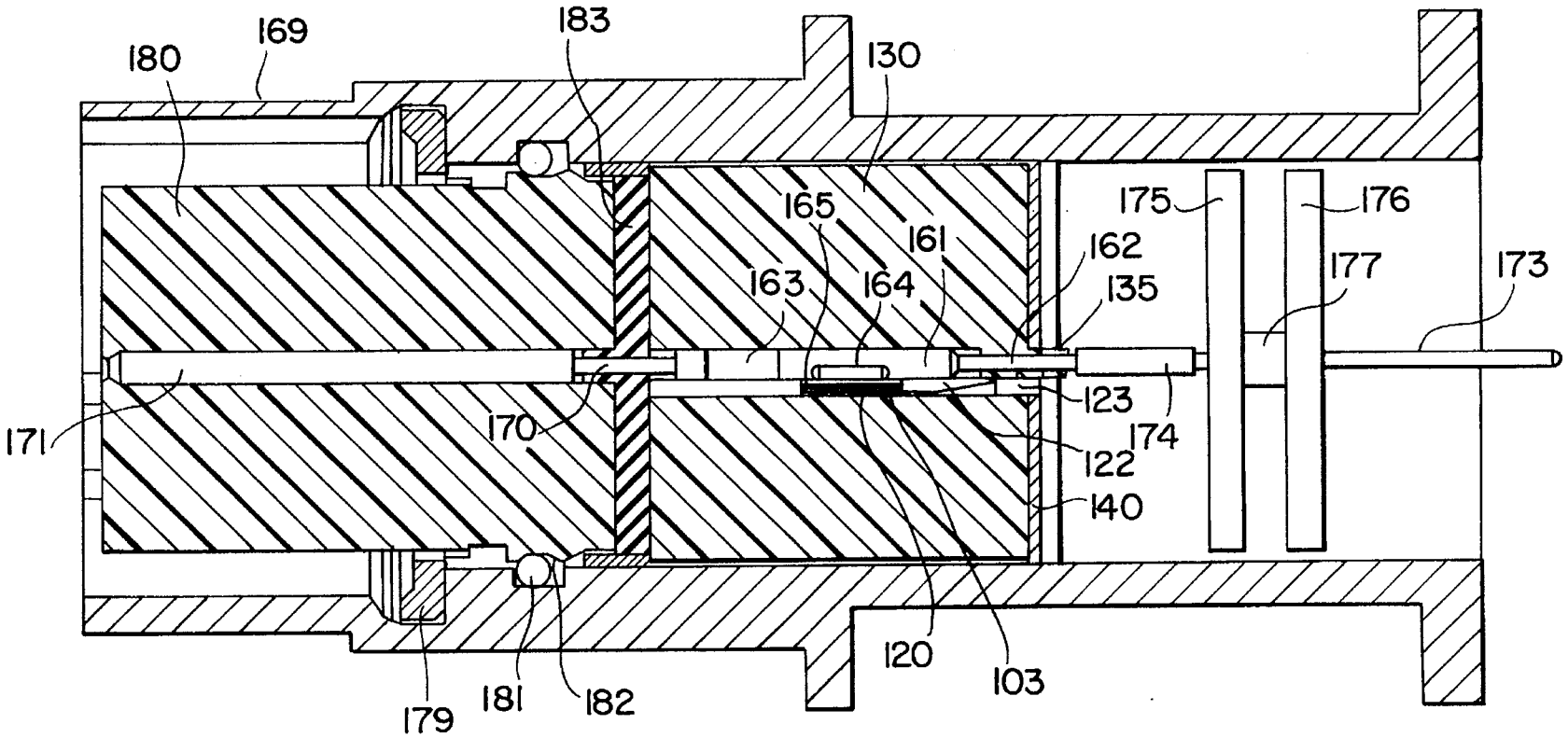
FIG. 12 is a cross-sectional side view of an example of a connector in which the various component assemblies and related parts shown in FIGS. 1–11 may be used.

FIG. 12 shows a connector housing 169 in which the component assembly of FIGS. 11(*a*) and 11(*b*) has been positioned to serve as a transient voltage suppression diode assembly. The illustrated connector includes a discrete contact 170 which engages tines 163 and which includes a socket portion 171 supported by front dielectric insert 180. The diode assembly itself is formed by elements 103, 120, 122, 123, and 161–165, as described above, and is positioned in a recess of dielectric insert 130. Insert 130 is accessed by removing front insert 180. Insert 180 may be removably retained in the connector by a keyed front gasket 179 and an O-ring 181 seated in a groove 182, for example of the type described in more detail in U.S. patent application Ser. No. 07/848,337, filed Mar. 9, 1992. Contact 170 engages tines 163 through an interfacial seal 183.

The pin portion 162 of the component assembly is electrically connected to a second discrete contact 173 via a socket 174. Contact 173 extends through a pi filter assembly including capacitor plates 175 and 176, and an inductor sleeve 177, and held in place by suitable support and grounding means (not shown). It will of course be appreciated that while only one contact assembly is shown in the illustrated cross-section, the connector will ordinarily have a plurality of such assemblies. In addition, it will be appreciated that the preferred component assemblies may be used in a wide variety of connectors other than the illustrated connector, which is intended to be exemplary in nature and not limiting, and that the preferred assemblies can further be used in devices other than electrical connectors.

Having thus described a number of preferred embodiments of the invention, it is nevertheless to be understood that the invention is not to be limited to any of the above embodiments or drawings, but rather is to be interpreted solely in accordance with the amended claims.

We claim:

1. A component adapted to be electrically connected between a feedthrough contact and ground in an electrical connector, comprising:

a component body;

a ground lead adapted to removably engage and electrically connect the component body to ground; and a live lead adapted to removably engage an exterior surface of a connector contact;

wherein said leads are integrally and fixedly connected to the component body such that said leads and component body are removable as a unit from both the connector and the contact, and wherein said live lead includes a projection extending in a direction transverse to a principal plane of said component body, said projection including a semi-cylindrical recess for engaging said contact.

2. A component as claimed in claim 1, wherein said ground lead is resilient and adapted to engage portions of a connector and provide a biasing force to push said live lead against said contact.

3. A component as claimed in claim 2, wherein said ground lead is a leaf spring member extending in opposite directions from said component body, one end of which is adapted to engage an extension of a ground plate in the connector, and the other end of which is adapted to engage a wall of a recess in a dielectric connector insert.

4. A component adapted to be electrically connected between a feedthrough contact and ground in an electrical connector, comprising:

a component body;

a ground lead adapted to removably engage and electrically connect the component body to ground; and a live lead adapted to removably engage an exterior surface of a connector contact;

wherein said leads are integrally and fixedly connected to the component body such that said leads and component body are removable as a unit from both the connector and the contact, and wherein said ground lead is resilient and adapted to engage portions of a connector and provide a biasing force to push said live lead against said contact.

5. A component as claimed in claim 4, wherein said live lead is a resilient member and said ground lead is a rigid planar member.

6. A component as claimed in claim 4, wherein said ground lead has a substantially U-shape, one leg of the U-shape being fixedly attached to said component body.

7. A component adapted to be electrically connected between a feedthrough contact and ground in an electrical connector, comprising:

a component body;

a ground lead adapted to removably engage and electrically connect the component body to ground; and a live lead adapted to removably engage .an exterior surface of a connector contact;

wherein said leads are integrally and fixedly connected to the component body such that said leads and component body are removable as a unit from both the connector and the contact, and wherein said live lead includes a cylindrical section adapted to extend substantially 360 degrees around said contact.

8. A component as claimed in claim 7, wherein said live lead further includes a planar flange fixedly attached to said component body.

9. A component as claimed in claim 7, wherein said cylindrical section includes a cylindrical main body having an axis and two tines extending from an end of said main body in a direction substantially parallel to said axis.

10. A component as claimed in claim 9, wherein said tines are inclined towards said axis such that a distance between distal ends of said tines is less than an interior diameter of said main body.

11. A component as claimed in claim 9, wherein said main body further comprises ribs extending parallel to said axis and projecting radially outwardly from an exterior surface of the main body.

12. A component as claimed in claim 11, wherein said live lead further includes a planar flange fixedly attached to said component body.

13. A component as claimed in claim 12, further comprising a second said planar flange, and wherein said planar flanges and cylindrical main body together form an omega-shaped cross-section.

14. A component as claimed in claim 13, wherein said tines are inclined toward said axis such that a distance between distal ends of said tines is less than an interior diameter of said main body.

15. A component as claimed in claim 14, wherein said main body further comprises ribs extending parallel to said axis and projecting radially outwardly from an exterior surface of the main body.

16. A component as claimed in claim 7, wherein said ground lead includes a first section fixedly attached to said component body and a termination section extending from said first section, said termination section having a free end adapted to engage an opening in a ground plate.

17. A component as claimed in claim 16, wherein said first section is metallurgically bonded to said component body.

18. A component as claimed in claim 16, wherein said first section of said ground lead is planar.

19. A component as claimed in claim 18, wherein said termination section is cylindrical.

20. A component adapted to be electrically connected between a feedthrough contact and ground in an electrical connector, comprising:

a component body;

a ground lead adapted to removably engage and electrically connect the component body to ground; and a live lead adapted to removably engage an exterior surface of a connector contact;

wherein said leads are integrally and fixedly connected to the component body such that said leads and component body are removable as a unit from both the connector and the contact, and wherein said live lead is a feedthrough lead having two ends, each end adapted to engage a connector contact.

21. A component adapted to be electrically connected between a feedthrough contact and ground in an electrical connector, comprising:

a component body;

a ground lead adapted to removably engage and electrically connect the component body to ground; and a live lead adapted to removably engage an exterior surface of a connector contact;

wherein said leads are integrally and fixedly connected to the component body such that said leads and component body are removable as a unit from both the connector and the contact, and wherein said ground lead includes a first section fixedly attached to said component body and a termination section extending from said first section, said termination section having a free end adapted to engage an opening in a ground plate.

22. A component as claimed in claim 21, wherein said first section metallurgically bonded to said component body.

23. A component as claimed in claim 21, wherein said first section is planar.

24. A component as claimed in claim 21, wherein said termination section is cylindrical.

25. A component as claimed in claim 21, wherein said live lead is a feedthrough lead having two ends, each end adapted to engage a connector contact.

26. A connector insert, comprising:

a dielectric main body having opposed substantially planar surfaces, one of said surfaces including a plurality of first contact openings and a plurality of component openings, respective ones of said first contact openings communicating with respective ones of said component openings, and a second of said surfaces including a plurality of second contact openings, each in communication with a respective one of said first contact openings via respective contact passages, said second surface also including a plurality of ground lead openings in communication with said component openings but separated from said second contact openings, whereby said contact passages are arranged to receive a plurality of electrical contacts, said component openings are arranged to receive electrical component bodies electrically connected to said contacts by live leads affixed to the component bodies, and said lead openings are arranged to receive ground leads extending from said and affixed to said electrical component bodies, said ground leads being electrically isolated by said insert from said contacts except via said component bodies.

27. A connector insert as claimed in claim 26, wherein said connector insert is cylindrical.

28. A connector insert as claimed in claim 26, further comprising a plurality of projections extending from said second surface and including said second contact openings.

29. A connector insert as claimed in claim 26, wherein said first and second contact openings are circular.

30. A connector insert as claimed in claim 29, wherein said component openings are rectangular.

31. A connector insert as claimed in claim 30, wherein said lead openings are circular.

32. A connector insert as claimed in claim 26, wherein said component openings are rectangular.

33. A connector insert as claimed in claim 32, wherein said lead openings are circular.

34. An electrical connector, comprising:

a ground plate;

an electrical contact passing through and insulated from said ground plate, and having an exterior surface;

an electrical component connected between said contact and said ground plate, wherein said component comprises:

a component body;

a ground lead adapted to removably engage and electrically connect the component body to the ground plate; and a live lead adapted to be removably engage the exterior surface of the connector contact, wherein said leads are integrally and fixedly connected to the component body and removably from the electrical connector with the component body such that said leads and component body are removable as a unit from both the connector and the contact, and wherein said live lead includes a projection extending in a direction transverse to a principle plane of said component body, said projection including a semi-cylindrical recess for engaging said contact.

35. An electrical connector, comprising:

a ground plate;

an electrical contact passing through and insulated from said ground plate, and having an exterior surface;

an electrical component connected between said contact and said ground plate, wherein said component comprises:

a component body;

a ground lead adapted to removably engage and electrically connect the component body to the ground plate; and a live lead adapted to be removably engage the exterior surface of the connector contact, wherein said leads are integrally and fixedly connected to the component body and removably from the electrical connector with the component body such that said leads and component body are removable as a unit from both the connector and the contact, and wherein said ground lead is resilient and adapted to engage portions of a dielectric insert recess in which the component is situated and provide a biasing force to push said live lead against said contact.

36. A connector as claimed in claim 35, wherein said ground lead is a leaf spring member extending in opposite directions from said component body, one end of which is adapted to engage an extension of the ground plate, and the other end of which is adapted to engage a wall of said recess.

37. An electrical connector, comprising:

a ground plate;

an electrical contact passing through and insulated from said ground plate, and having an exterior surface;

an electrical component connected between said contact and said ground plate, wherein said component comprises:

a component body;

a ground lead adapted to removably engage and electrically connect the component body to the ground plate; and a live lead adapted to be removably engage the exterior surface of the connector contact, wherein said leads are integrally and fixedly connected to the component body and removably from the electrical connector with the component body such that said leads and component body are removable as a unit from both the connector and the contact, and wherein said live lead is a resilient member and said ground lead is a rigid planar member.

38. An electrical connector, comprising:

a ground plate;

an electrical contact passing through and insulated from said ground plate, and having an exterior surface;

an electrical component connected between said contact and said ground plate, wherein said component comprises:

a component body;

a ground lead adapted to removably engage and electrically connect the component body to the ground plate; and a live lead adapted to be removably engage the exterior surface of the connector contact, wherein said leads are integrally and fixedly connected to the component body and removably from the electrical connector with the component body such that said leads and component body are removable as a unit from both the connector and the contact, and wherein said live lead includes a cylindrical section adapted to extend substantially 360° around said contact.

39. A connector as claimed in claim 38, wherein said live lead further includes a planar flange fixedly attached to said component body.

40. A connector as claimed in claim 38, wherein said main body further comprises ribs extending parallel to said axis and projecting radially outward from an exterior surface of the main body in order to engage a wall of a passage in a dielectric insert in which the component is inserted to frictionally hold the component in the passage.

41. A connector as claimed in claim 27, wherein said ground lead includes a first section fixedly attached to said component body and a termination section extending from said first section, said termination section having a free end shape to engage the first opening in said ground plate.

42. A connector as claimed in claim 38, wherein said cylindrical section includes a cylindrical main body having an axis and two tines extending from an end of said main body in an direction substantially parallel to said axis.

43. A connector as claimed in claim 42, wherein said tines are inclined towards said axis such that a distance between distal ends of said tines is less than an interior diameter of said main body.

44. A connector as claimed in claim 42, further comprising a second said planar flange and wherein said planar flanges and cylindrical main body together form an omega-shaped cross section.

45. An electrical connector, comprising:

a ground plate;

an electrical contact passing through and insulated from said ground plate, and having an exterior surface;

an electrical component connected between said contact and said ground plate, wherein said component comprises:

a component body:

a ground lead adapted to removably engage and electrically connect the component body to the ground plate; and a live lead adapted to removably engage the exterior surface of the connector contact, wherein said leads are integrally and fixedly connected to the component body and removable from the electrical connector with the component body such that said leads and component body are removable as a unit from both the connector and the contact, wherein said ground lead includes the first section fixedly attached to said component body and a termination section extending from said first section, said termination section having a free end adapted to engage in opening in said ground plate, and wherein said first section is planar and said termination section is cylindrical.

46. An electrical connector, comprising:

a ground plate;

an electrical contact passing through and insulated from said ground plate, and having an exterior surface;

an electrical component connected between said contact and said ground plate, wherein said component comprises:

a component body:

a ground lead adapted to removably engage and electrically connect the component body to the ground plate; and a live lead adapted to be removably engage the exterior surface of the connector contact, wherein said leads are integrally and fixedly connected to the component body and removable from the electrical connector with the component body such that said leads and component body are removable as a unit from both the connector and the contact, and wherein said ground lead a first section fixedly attached to said component body and a termination section extending from said first section, said termination section having a free end adapted to engage an opening in said ground plate, and further comprising a dielectric main body having opposed substantially planar end surfaces, one of said surfaces including a plurality of first contact openings, and a second of said surfaces including a plurality of second contact openings, said contact openings being connected by a plurality of contact passages, and wherein said first surface further comprises a plurality of component openings for receiving respectives ones of said component, said component openings being in communication with said first contact openings, and said second surface including a plurality of ground lead openings in communication with said component openings for receiving the termination sections of respective ground leads of said components, said ground lead opening being electrically isolated from said second contact openings.

47. A connector as claimed in claim 46, further comprising a plurality of projections extending from said second surface and including said second contact openings, said projections extending through openings in said ground plate to isolate said contacts from said ground plate.

48. A connector as claimed in claim 46, wherein said termination sections are cylindrical and said ground lead openings are circular.

49. A connector as claimed in claim 48, wherein axes connecting centers of openings in said pairs are non-parallel.

50. A connector as claimed in claim 46, wherein said ground plate comprises a plurality of pairs of closely-spaced adjacent openings, one opening of each pair for receiving a projection extending from said second surface, and a second opening of each pair engaging a respective one of the termination sections.

51. A connector as claimed in claim 50, wherein axes connecting centers of openings in said pairs are non-parallel.

52. An electrical connector, comprising:

a ground plate;

an electrical contact passing through and insulated from said ground plate, and having an exterior surface;

an electrical component connected between said contact and said ground plate, wherein said component comprises:

a component body;

a ground lead adapted to removably engage and electrically connect the component body to the ground plate; and a live lead adapted to be removably engage the exterior surface of the connector contact, wherein said leads are integrally and fixedly connected to the component body and removably from the electrical connector with the component body such that said leads and component body are removable as a unit from both the connector and the contact, wherein said ground lead includes a first section fixedly attached to said component body and a termination section extending from said first section, said termination section having a free end adapted to engage an opening in said ground plate, and further comprising a dielectric main body having opposed substantially planar end surfaces, one of said surfaces including a plurality of first contact openings, and a second of said surfaces including a plurality of second contact openings, said contact openings being connected by a plurality of contact passages, and wherein said first surface further comprises a plurality of component openings for receiving respective ones of said component, said component openings being in communication with said first contact openings, and said second surface including a plurality of ground lead openings in communication with said component openings for receiving the termination sections of respective ground leads of said components, said ground lead openings being electrically isolated from said second contact openings.

53. A connector as claimed in claim 52, wherein said connector insert is cylindrical.

54. A connector as claimed in claim 52, further comprising a plurality of projections extending from said second surface and including said second contact openings, said projections extending through openings in said ground plate to isolate said contacts from said ground plate.

55. A connector as claimed in claim 52, wherein said first and second contact openings are circular.

56. A connector as claimed in claim 52, wherein said first and second contact openings are circular.

57. A connector as claimed in claim 56, wherein said component openings are rectangular.

58. A connector as claimed in claim 57, wherein said ground lead openings are circular.

59. A connector as claimed in claim 46, wherein said live lead is a feedthrough lead having two ends, each end adapted to engage a connector contact.

60. A connector as claimed in claim 59, wherein one of said feedthrough leads ends is a pin and the other is a socket.

61. A connector as claimed in claim 59, wherein each of said ends is a pin.

* * * * *